United States Patent [19]

Oger et al.

[11] 4,318,637

[45] Mar. 9, 1982

[54] PROCESS AND DEVICE FOR THE ASSEMBLY OF VOUSSOIRS FOR TUNNEL LININGS

[75] Inventors: Jacques F. Oger, Pont-A-Mousson; Jean-Claude Hauer, Saulxures les Nancy, both of France

[73] Assignee: Pont-A-Mousson S.A., Nancy, France

[21] Appl. No.: 112,255

[22] Filed: Jan. 15, 1980

[30] Foreign Application Priority Data

Jan. 15, 1979 [FR] France ..... 79 00884

[51] Int. Cl.[3] ..... E21D 11/22

[52] U.S. Cl. ..... 405/153; 52/584

[58] Field of Search ..... 405/152, 153, 151, 150; 403/314, 367, 368; 52/584, 640, 645, 248

[56] References Cited

U.S. PATENT DOCUMENTS

| | | | |
|---|---|---|---|
| 1,307,973 | 6/1919 | Hester | 52/584 X |
| 1,844,184 | 2/1932 | Schaefer et al. | 405/152 |
| 2,213,402 | 9/1940 | Lowry | 52/584 X |
| 2,384,198 | 9/1945 | Sheldon | 52/584 X |
| 2,404,819 | 7/1946 | White | 405/153 |
| 2,962,133 | 11/1960 | Kivett et al. | 52/584 X |
| 4,037,417 | 7/1977 | Oger | 405/151 |

FOREIGN PATENT DOCUMENTS

| | | | |
|---|---|---|---|
| 534544 | 9/1931 | Fed. Rep. of Germany | 402/151 |

*Primary Examiner*—Dennis L. Taylor

*Attorney, Agent, or Firm*—Sughrue, Mion, Zinn, Macpeak & Seas

[57] ABSTRACT

Two voussoirs forming part of a tunnel lining have their adjacent longitudinal sides in mutual contact, each side having a convex radial profile. The voussoirs are rigidly locked relative to each other by circumferential bolts 10 and by wedges 15 and 16 wedged into opposing recesses in the adjacent sides by radial bolts 17. In comparison to the 180° relative angular position of the voussoirs which occurs when the radius of the lining is equal to that of the voussoirs, an angular position, higher or lower than 180°, can be used in order to obtain a lining radius larger or smaller than that of the voussoirs.

5 Claims, 7 Drawing Figures

PROCESS AND DEVICE FOR THE ASSEMBLY OF VOUSSOIRS FOR TUNNEL LININGS

BACKGROUND OF THE INVENTION

The present invention relates to voussoirs having the general shape of a segment of a cylinder, which are used in particular for tunnel linings.

The tunnel linings formed by known voussoirs are of the shape of a cylinder with a radius the same as that of the voussoirs which are, themselves, segments of a cylinder. Such an arrangement has no disadvantages when it is for the construction of a very long tunnel, as the high number of voussoirs which need to be produced justifies the investments required for the manufacture of voussoirs having the predetermined shape required for the radius of the tunnel lining. This is not so in the case of a tunnel of short length or when the voussoirs are to be used to recondition or repair an existing tunnel, in particular to consolidate the roof of an old concrete lining where the side walls have to be kept, because the voussoirs then have to adapt to a pre-established, possibly variable, lining profile.

It is known, in particular from French Pat. No. 2,264,921 (corresponding to U.S. Pat. No. 4,037,417), in the name of the present assignee, to use voussoirs comprising longitudinal sides which have radial profiles with predetermined curvatures, and equipped with embossments and centering recesses. However, in these voussoirs the curvature of one side is convex and that of the other is concave and, as has already been said, they are intended exclusively for cylindrical linings whose radius is the same as that of the voussoirs.

SUMMARY OF THE INVENTION

Consequently, the invention provides a process for assembling two voussoirs, each having the general form of a segment of a cylinder with a radius R and with two longitudinal sides each of whose radial profile has a predetermined curvature, for producing a tunnel lining or a well lining, such as to obtain locally, at will, a lining corresponding to a radius which is equal, greater or lesser than R, wherein the adjacent sides of two voussoirs are placed in rolling contact basically following a contact line parallel to the axis of the cylinder defining the voussoirs, by adjustably arranging this contact line in such a manner that the planes tangential to the respective extrados faces of the voussoirs to the right of the interface make an angle equal to, greater or lesser than 180°, according to whether the lining radius should be equal to, lesser or greater than R, and then rigidly locking the two voussoirs relative to each other, in the chosen angular position.

This arrangement, while using identical voussoirs produced in series in mechanized lining installations, enables one to obtain either (1) parts of linings which have either a cylindrical profile of the same radius as the voussoirs themselves or (2) a prism with a curvilinear polygonal cross-section equivalent to a cylinder having a different radius from that of the voussoirs, or (3) even the equivalent, for example, to a surface of cross-section of a curve composed of arcs of three circles (basket handle) and which corresponds to a normal profile for a railway tunnel roof.

The locking of two adjacent voussoirs is advantageously executed on the one hand, in the classical manner, using circumferential bolts which traverse the sides and are in mutual contact with the voussoirs, and on the other hand by counterbracing components each comprising two wedges respectively adjacent to the extrados face and the intrados face of the voussoirs, which wedges are applied against the faces which are recessed relative to the contacted sides and which are connected with each other by a radial bolt threaded through an opening in a centering embossment of one of the sides which engages in a conjugated recess of the other side.

In the description which follows, the adjectives circumferential, longitudinal, transverse, axial and radial, are understood to relate to the lining considered as a whole.

DETAILED DESCRIPTION OF THE PREFERRED EMBODIMENT

Figure 1:
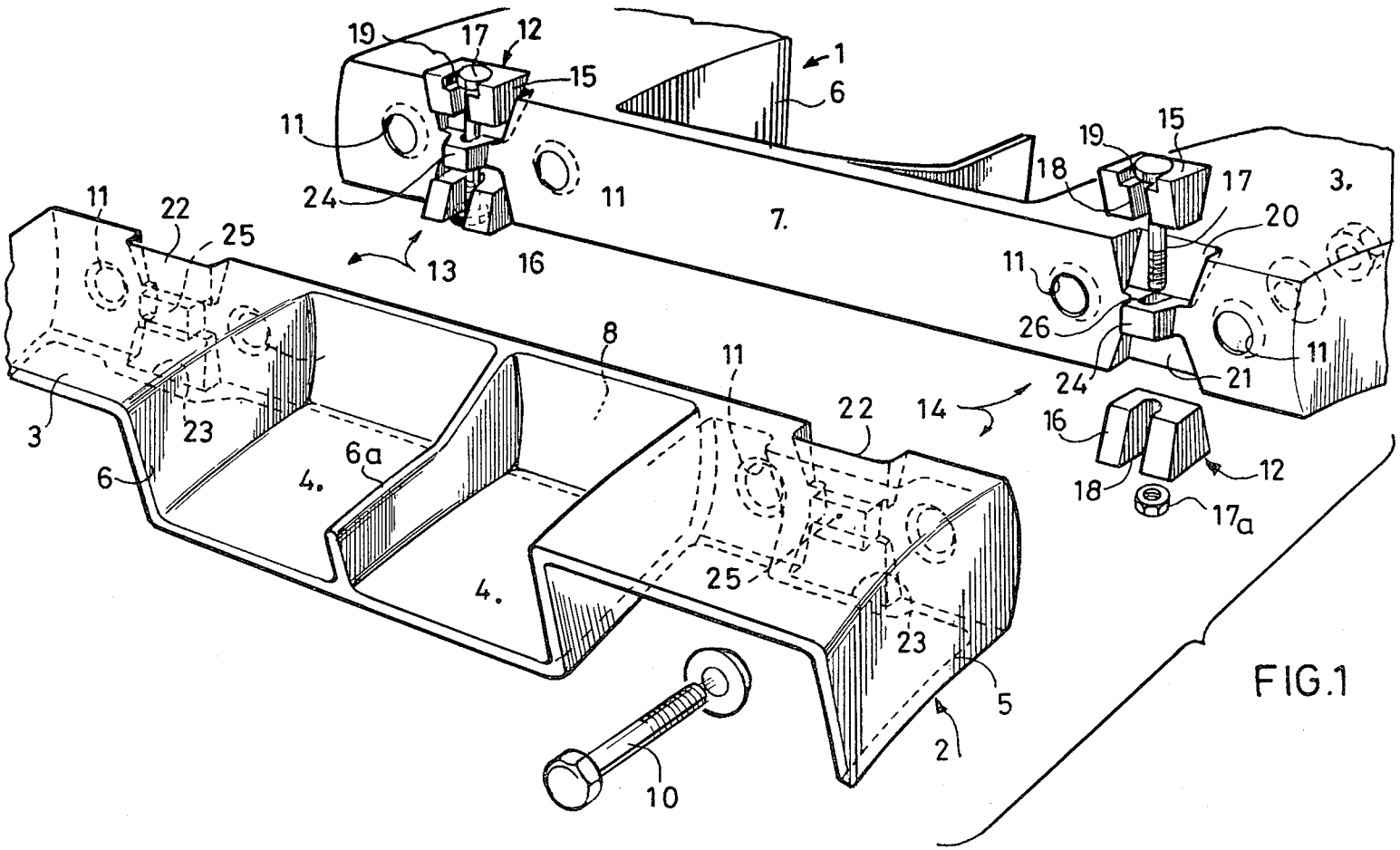
FIG. 1 is an exploded view in perspective of the conjugates parts of two identical adjacent voussoirs which are to be assembled.

FIG. 1 is a partial illustration of two identical voussoirs 1 and 2 of a tunnel lining with an X—X axis, which is assumed to be horizontal.

These voussoirs, cast in cast-iron in the described embodiment, but able to be made of another material, comprise covers associated with the cylindrical surfaces, and ribs associated with the transverse or longitudinal planes.

The covers 3 belong to the external face of the linings, and the cover 4 to its internal face. Reference numeral 5 designates flat end walls of the voussoirs, which correspond to the transverse planes of the linings. The same applies to the ribs 6 and **6*a***.

Finally, reference numerals 7 and 8 designate the longitudinal sides of voussoir 1 and voussoir 2 respectively, which, during assembly, should act in mutual support.

Figure 3:
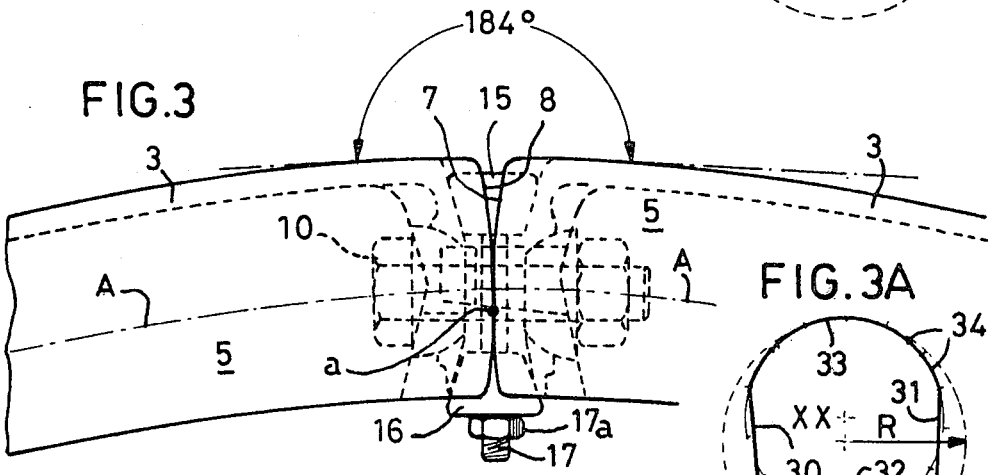
FIG. 3 is an elevational view of two voussoirs assembled so as to form a polygonal curvilinear-shaped lining equivalent to a cylindrical lining with a radius lesser than R.
Figure 4:
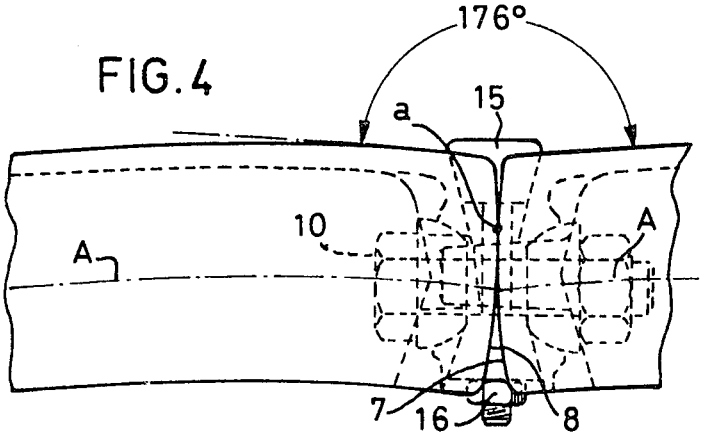
FIG. 4 is an elevational view of two voussoirs assembled so as to form a polygonal curvilinear-shaped lining equivalent to a cylindrical lining with a radius greater than R.

FIGS. 3 and 4 are indicative of the manner in which these cylindrical voussoirs, whose curve radius at the external face is R, can be assembled to form prismatic surfaces of a polygonal curvilinear cross-section equivalent to the cylindrical surfaces with a radius different from that of the cylindrical covers 3, 4 of the voussoirs. These voussoirs can also be connected to form polygonal curvilinear surfaces which are not equivalent to the cylindrical circular cross-sectional surfaces.

For this purpose opposite longitudinal sides 7 and 8 of the voussoirs 1 and 2 both have a radial convex profile as is shown in FIGS. 1 to 4, such that in the assembled voussoirs (FIGS. 2 to 4), the sides 7 and 8 are theoretically in contact along an axial perpendicular line a which coincides with a common generant to the two cylindrical surfaces defining the convex profile of the sides. This perpendicular contact line a can be radially offset relative to the circumferential center line A of the voussoirs, following the relative angular position of the voussoirs whose sides 7, 8 can roll one on the other. Naturally the contact between the sides 7, 8 extends over a small radial surface, on both sides of the theoretical line a because of a certain compaction.

When the contact is made, a circumferential connection between the voussoirs 1, 2 is provided by the screwing of bolts 10 passing in the holes 11 made circumferentially in the thickness of the opposite sides 7 and 8.

According to the invention, the voussoirs are rigidly locked in the relative angular position which has been given them, at the same time creating a bridge between voussoirs for the transmission of mechanical forces, by means of counterbracing components 12 which are arranged between the sides to provide a circumferential wedging in the area of the external face and internal faces of the linings. In the embodiment described, these components are localized in two zones 13 and 14 axially spaced from the sides of the voussoir. Each of these counterbracing components comprises two wedges 15, 16 in the shape of a trapezoidal-based prism, connected one to the other by a radial bolt 17 fastened by means of a screw 17*a*. The wedge 15 has its large base near the external face of the voussoir, whereas the other wedge 16 has its large base near the internal face.

In the embodiment described, these wedges have a longitudinal dimension which is on the order of the radial distance between the internal and the external faces of the linings, and the transversed dimension of the wedges is on the order of one-third or one-half of the logitudinal dimension.

In each wedge 15, 16, one of the lateral faces of the prism is cut to form a notch 18 intended to facilitate molding. In addition, the large base of the wedge 15, near the external face, is cut to form a shoulder 19 which supports the head of bolt 17 and which defines a housing whose contour coincides with the hexagonal head of the bolt to ensure retention during screwing.

The wedges 15 and 16 fit into notches 20, 21 provided in the side 7, and 22, 23 provided in side 8, where the longitudinal dimension is slightly greater than that of the wedges themselves. The bottom of each notch forms a flat facet which extends as far as the cylindrical surface of the corresponding external face or internal face, in relation to which it has a certain obliqueness which corresponds to that of the lateral face of the related prismatic wedge.

The tightening of the nut 17*a* on bolt 17 has the effect of bringing together radial wedges 15 and 16, while compelling them to apply themselves under pressure against the facets of the notches, thus locking the two voussoirs in the angular position which has been given them.

Figure 2:
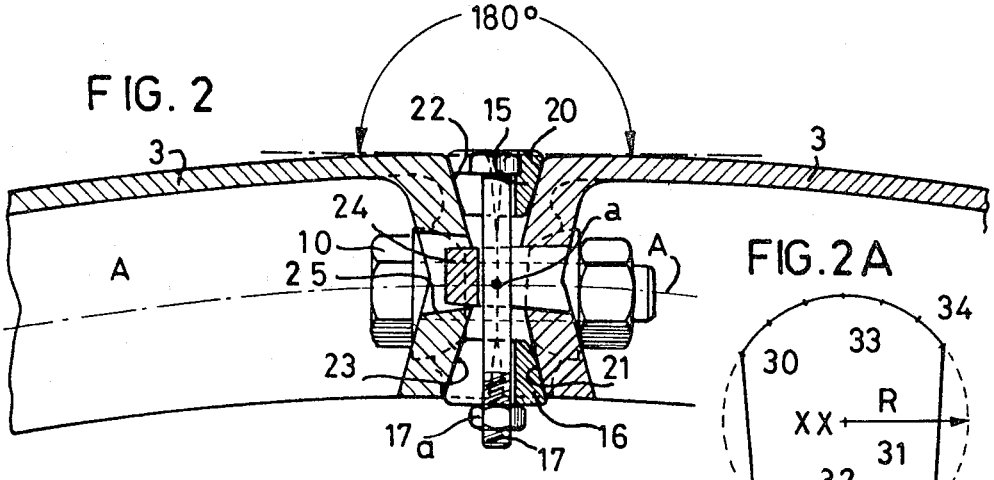
FIG. 2 is a partial transverse sectional view of two voussoirs assembled in such a manner as to form a cylindrical lining whose radius is equal to the radius R of the voussoirs.

FIGS. 2, 3 and 4 show that in each counterbracing component 12 the wedges 15, 16 take on different radial positions according to the relative angle between voussoirs.

If, according to FIG. 2, the lining has the form of a cylinder with the same radius R, measured at the external face, as the defined cylinder of the voussoirs which constitute the lining, the two planes tangential to the external faces of the abutting voussoirs make a dihedral angle of 180° and the two wedges 15 and 16 of the counterbracing component 12 take a median position in which the two wedges 15 and 16 are equidistant from the circumferential center line A which also coincides with the contact line a of the two sides of the voussoir.

If, according to FIG. 3, the lining has the form of a polygonal curvilinear cross-sectional prism equivalent to the cylinder with a smaller diameter than that of the voussoirs, then the axial contact line a between the sides 7 and 8 is inside the center line A of the voussoirs, and the planes tangential to the adjacent extrados faces make an angle greater than 180°. In the embodiment described, the maximum angle planned for and shown is 184°. The wedges 15, 16 of the counterbracing component are then radially offset towards the X—X axis of the lining.

FIG. 4 shows the reverse arrangement from that of FIG. 3, in which the lining has the form of a polygonal curvilinear cross-sectional prism equivalent to the cylinder but with a diameter greater than that of the voussoirs; the axial contact line a between the sides is then outside the center line A of the voussoirs, and the wedges 15, 16 are radially offset in the opposite direction from the X—X axis of the lining.

FIG. 3 can also represent a connection between voussoirs near the ends of the large diameter of a lining in the form of a curve composed of arcs of three circles or of an ellipse. In the same way FIG. 4 can represent a connection between voussoirs near the end of a small diameter of the same lining.

Side 7 of voussoir 1 also contains two embossments 24 for automatic centering, provided during molding as a circumferential projection in relation to notches 20, 21 for receiving the wedges 15, 16. In side 8, two recesses 25 between the notches 22, 23 correspond to these automatic centering embossments.

Each automatic centering embossment 24 contains a radial hole 26 to enable the passage of the bolt 17 for connection of the two wedges 15 and 16. This embossment, seen flat, therefore has the form of a handle, projecting from the counterbracing component, and is fitted into the corresponding recess 25.

The mounting in the cavity to the lining is done as follows:

Voussoir 1 has two blocking zones 13 and 14 whose embossment 24 supports a combination comprising wedges 15, 16, the connecting bolt 17 and the screw 17*a*.

By taking advantage of the play provided between the automatic centering embossments 24 and the conjugated recesses 25, and by means of the rolling contact between sides 7, 8 of the voussoirs 1 and 2, the voussoirs are given an angular position corresponding to one of the configurations represented in FIGS. 2, 3 and 4, in accordance with the geometry of the lining.

Bolts 10 are then threaded through bores 11 and a manual screw-down of these bolts is carried out. The bolts 17 are then screwed down tight, the heads being blocked against rotation in the housings defined by shoulders 19. Finally the blocking is carried out, for example by means of a dynamometric wrench, of the circumferential connection bolts 10.

The means of assembly described presents, as can be seen, considerable flexibility in the use of standard voussoirs for the lining of cavities which vary in form and in size. This flexibility is very advantageous in providing linings for cylindrical tunnels with radii of from two meters (FIG. 3) to six meters (FIG. 4), by using for example voussoirs with a radius of four meters, a circumferential dimension of 760 mm and a thickness of 80 mm. With these voussoirs, tunnels with at least partially elliptical cross-sections can be clad.

On the other hand, the voussoirs described can be used to reclad old railway tunnels where the transversal cross-section can vary over the whole length of the longitudinal profile of the tunnel. This provides, in this case, a lining exactly to size but made from standard elements.

Figure 2A:
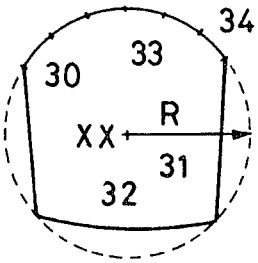
FIGS. 2A, 3A and 4A schematically illustrate roof linings obtained by assembling voussoirs, in accordance with FIGS. 2, 3 and 4, respectively.
Figure 3A:
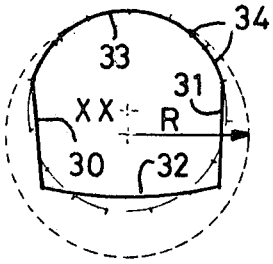
Figure 4A:
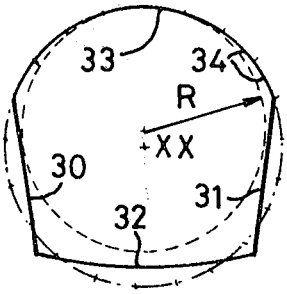

By way of example, FIGS. 2A, 3A and 4A represent, very schematically, railway tunnel profiles, where the initial concrete lining, comprising side walls 30, 31 and floor 32, has been consolidated by a relining of the roof 33 of the X—X axis by means of voussoirs 34 identical to voussoirs 1 and 2, assembled in accordance with the configurations of FIGS. 2, 3 and 4, respectively. The dotted outline represents the geometrical prolongation of the roof 33 which, in FIG. 2A, is a cylinder of radius R, in FIG. 3A a polygonal curvilinear cross-sectional prism equivalent to a cylinder with a radius less than R, and in FIG. 4A a polygonal curvilinear cross-sectional prism equivalent to a cylinder with a radius greater than R.

What is claimed is:

1. A method of assembling at least two adjacent tunnel or well lining voussoirs, each having the general shape of a segment of a cylinder with a radius R, each comprising at least a cylindrical cover, two flat transverse walls and two longitudinal sides each having a radial profile which is convex relative to that of the adjacent voussoir, wherein linings corresponding to a radius which is equal to, lesser or greater than R may be obtained, comprising: adjustably placing the curved adjacent sides of two voussoirs in abutment in rolling contact along a contact line parallel to the axis of the cylinder defining the voussoirs by selectively locating this contact line such that the planes tangential to the respective external faces of the abutting sides of the voussoirs assume an angular position of an angle equal to, greater or less than 180°, in dependence on whether the radius of the lining should be equal to, less or greater than R, and then rigidly locking the two voussoirs relative to each other in the angular position selected.

2. In a voussoir assembly of at least two adjacent voussoirs for forming a generally cylindrical lining of a tunnel or well, which voussoirs have the general form of a segment of a cylinder and have longitudinal sides in mutual contact over the length thereof, and wherein the radial profile of each longitudinal side has a predetermined curvature, the improvement wherein the adjacent longitudinal sides of the two voussoirs both have a convex radial profile and are in mutual contact along an axially extending contact line, and further comprising adjustable counterbracing means, supported in opposing recesses formed in the extrados and intrados surfaces of the adjacent voussoirs, for adjustably radially displacing the contact line to change the relative angular position of the adjacent voussoirs and for rigidly locking the voussoirs in the angular position.

3. The improvement of claim 2, wherein the counterbracing means comprises two wedges mounted in the recesses on either side of the contact line, and a bolt extending radially through the wedges for bringing them nearer one to the other, while at the same time pressing them into contact with the adjacent sides of the voussoirs.

4. The improvement according to claim 3, wherein the wedges are trapezoidal shaped prisms, the large bases of these prisms being, with regard to one wedge, adjacent the extrados face, and with regard to the other wedge, adjacent the intrados face.

5. The improvement according to claim 4, wherein the large base next to the extrados face has a shoulder for supporting the head of said bolt and for blocking rotation of the bolt.

* * * * *